US005599091A

United States Patent [19]

Kira

[11] Patent Number: 5,599,091

[45] Date of Patent: Feb. 4, 1997

[54] LANDSCAPE LIGHTING FIXTURE

[75] Inventor: Hiroshi Kira, Westlake Village, Calif.

[73] Assignee: Lumiere Design & Manufacturing, Inc., Westlake Village, Calif.

[21] Appl. No.: 597,024

[22] Filed: Feb. 5, 1996

[51] Int. Cl.[6] ..... F21V 21/30

[52] U.S. Cl. ..... 362/269; 362/287; 362/427; 362/294

[58] Field of Search ..... 362/199, 285, 362/287, 269, 270, 368, 370, 371, 391, 418, 427, 431, 294, 373

[56] References Cited

U.S. PATENT DOCUMENTS

| | | | |
|---|---|---|---|
| 2,921,182 | 1/1960 | Taylor | 362/199 |
| 4,165,530 | 8/1979 | Sowden | 362/427 |
| 4,210,797 | 7/1980 | Tomaro | 362/199 |
| 4,432,042 | 2/1984 | Zeller | 362/285 |
| 4,459,646 | 7/1984 | Drane | 362/199 |
| 4,706,331 | 11/1987 | Compton | 362/427 |
| 4,974,130 | 11/1990 | Friedman | 362/199 |
| 5,410,457 | 4/1995 | Parker | 362/199 |

*Primary Examiner*—Ira S. Lazarus
*Assistant Examiner*—Thomas M. Sember
*Attorney, Agent, or Firm*—Wagner & Middlebrook

[57] ABSTRACT

A lamp fixture includes a lamp assembly in a generally cylindrical housing having a radially extending flange at one end. A base for the housing includes mating halves each of which has a flange at one end, these flanges cooperating with the radially extending flange to form a pivot connection between the housing and the base. A pair of contact members of conducting material having arcuate contact surfaces are secured in the pivot connection on opposite sides of the radially extending flange and are connected to electrical terminals in the base. A pair of contact pins connected to the lamp assembly ride on the arcuate contact surfaces throughout any adjustment of the pivot connection. Electrical terminals in the base are fastened to the contact members. Positioned between the mating halves of the base is a wire guide which includes grooves cooperating with grooves in the mating halves to direct conducting wires to the terminals. Electrical conductors are directed to the wire guide either through ports in the side of the base or through a threaded mounting collar on the bottom of the base.

14 Claims, 3 Drawing Sheets

24
64
52
20
22
66
88
68
54
70
76
31
84
78
30
62
28
86
86
82
58
72
74
76
84
76
31
30
28
62
80
77
26

LANDSCAPE LIGHTING FIXTURE

BACKGROUND OF THE INVENTION

For several decades there has been a market for certain specialized types of outdoor or garden lighting fixtures. In addition to lamps mounted on poles at some height for area illumination, there has been a demand for lamps on short posts or stands for illuminating walkways or shrubbery. In general, fixtures for mounting at a substantial height for area or even for spot lighting are quite different from fixtures for illuminating walkways or shrubs. Groups of fixtures for lighting walkways are typically designed to be connected in parallel along a single pair of wires and are designed such that individual fixtures may be readily added to or deleted from the group, all of which are supplied from a single transformer. Area or spot lighting fixtures are ordinarily connected to the power source as separate units.

It is believed that there is a need for a flexible, relatively inexpensive and attractive lighting fixture which can be installed in any of a number of locations such as on elevated poles, on trees, on walkways, over doorways and on the ground to illuminate buildings or shrubbery and other plantings, and which are readily added to or deleted from a plurality of such lamps connected to a single power source. Such lamps should be durable, weather resistant and secure from damage from moisture, particularly from rain or freezing conditions.

SUMMARY OF THE INVENTION

The present invention concerns a lighting fixture having a generally cylindrical housing for a halogen lamp socket, a lamp and a reflector, the housing being attached through a pivotable connection to a base. The base includes a standard male threaded stem to accept standard boxes, wall plates, ground boxes, conduit fittings, etc.

The pivotable connection includes a pair of electrical connector devices having arcuate surfaces which are secured to metal wiring terminals in the base. The halogen lamp socket is connected by wires to contact pins which ride on the arcuate surfaces so that electrical connection is made through the pivotable connection irrespective of the pivot angle between the housing and the base.

The base is formed of two molded plastic halves each of which carries one set of the metal wiring terminals. Secured in the hollow interior of the base between the halves is a molded plastic guide member having large area opening facing the hollow interior of the threaded stem whereby pairs of wires can be inserted through the stem into the guide member which guides the wires into receptacles in the metal wiring terminals. The wires are secured by set screws accessible from outside the base.

Each half of the base also includes near its lower end, an opening which is adjacent the guide member for receiving electrical wires to be fed through the guide member to the metal wiring terminals. Thus the wires for connecting the lamp fixture to a power source may be supplied through the stem into the guide member or through the openings near the bottom of the base. This would supply power to this particular lamp.

Should it be desired to add another such fixture it can be powered from the fixture discussed by pushing a second pair of wires either through the stem or through a second opening in the base adjacent the guides on the opposite side of the guide member and connecting the wires to a second set of contacts on the metal wiring terminals.

The housing for the lamp is formed of three generally cylindrical parts, one of which includes a flange forming part of the pivotable connection, and which carries the lamp socket to which the lamp and the reflector are attached. The second cylindrical part is attached to the first part by means of a bayonet connection which, during attachment of the second part to the first, squeezes the second part against a high temperature seal secured to the first part. Attached at the opposite or outboard end of the second part is an adjustable glareshield which is radially adjustable to prevent glare in any desired direction.

BRIEF DESCRIPTION OF THE DRAWING

This invention may be more clearly understood with the following detailed description and by reference to the drawings in which.

DESCRIPTION OF THE PREFERRED EMBODIMENT

Figure 1:
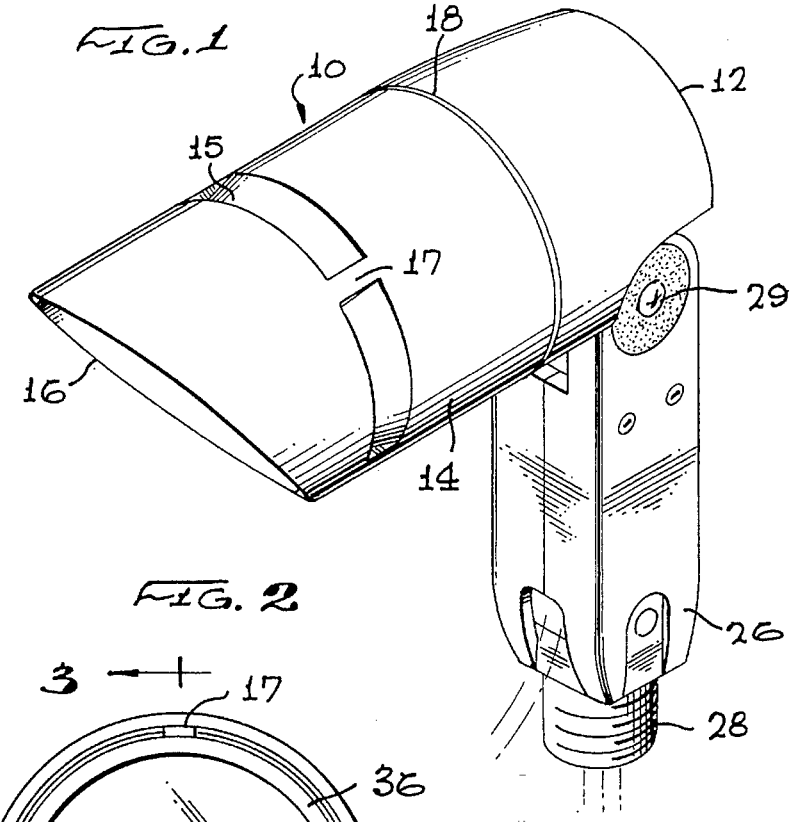
FIG. 1 is a perspective view of a lamp fixture according to the invention.

FIG. 1 is a perspective view of a lamp fixture according to the invention. A housing, shown generally at numeral 10 includes three parts of which cylindrical part 12 contains the lamp base and a flange, a second cylindrical part 14 which actually surrounds the lamp and its reflector and which includes a lens 13, and an adjustable glareshield 16 which is secured to part 14 in such manner that the glareshield 16 may be adjusted radially to prevent glare in any desired direction. Cylindrical part 14 is secured to part 12 by means of a bayonet-type connector, not shown in this view. The connector operates to squeeze part 14 against a high temperature seal 18 secured to part 12. Member 14 has a reduced diameter portion 15 at its outboard end including a plurality of notched fasteners 17 which secure glareshield to part 14. Between fasteners 17 are arcuate openings which permit water to drain away from part 14 and lens 13.

The flange 20 of part 12 (FIG. 2) cooperates with upstanding flanges 22 and 24 of a base 26 which supports the housing 10 to provide a pivotable connection between housing 10 and base 26. The base 26 includes two essentially mirror image molded halves, each of which includes one of flanges 22 and 24. Each half of base 26 also includes half of a mounting stem 28 and a dividing wall such that when the halves of the base 26 are joined, the inside of stem 28 is divided into two separate halves, as discussed below. An adjustment screw 29 passing through the center of flanges 22 and 24 and flange 20 can be loosened to permit housing 10 to rotate around the pivot to a desired angle after which the screw is tightened to secure the housing at the desired angle.

Figure 2:
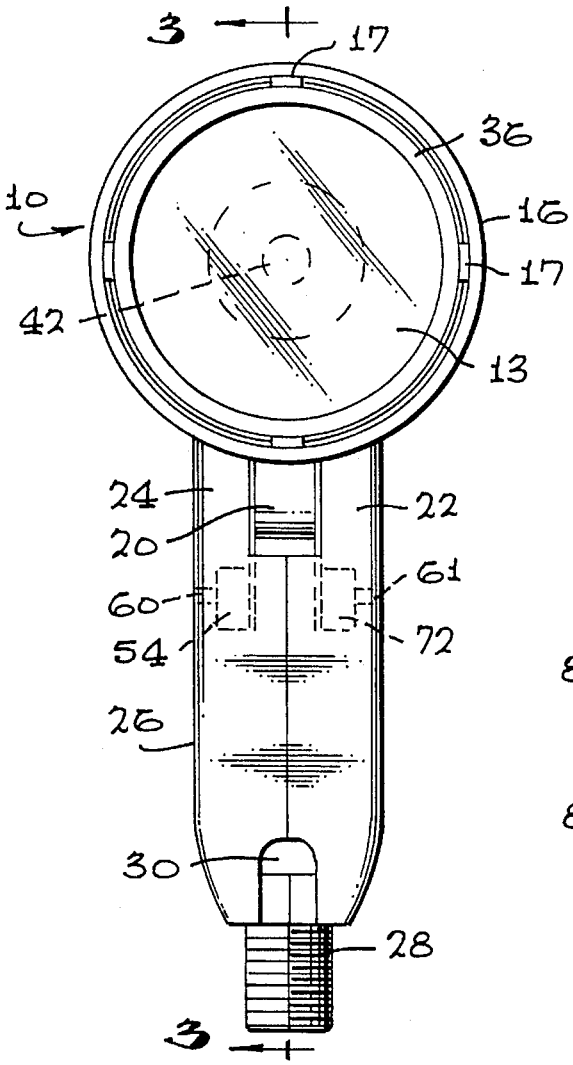
FIG. 2 is an end view of the lamp fixture of FIG. 1.

FIG. 2 is a view of the lamp fixture as seen from the lens end. This view shows housing 10 and flange 20 positioned between flanges 22 and 24, each forming one half of the base 26. In addition to mounting stem 28, this view shows an opening 30 through which wires may be inserted. Looking into the lens 13 one can also see the ends of the plurality of molded hook-like fastener members 17 which secure glareshield 16 to cylindrical part 14 while permitting the glareshield to be rotated for adjustment. Also shown is a seal 36 which seals around the lens 13.

Figure 3:
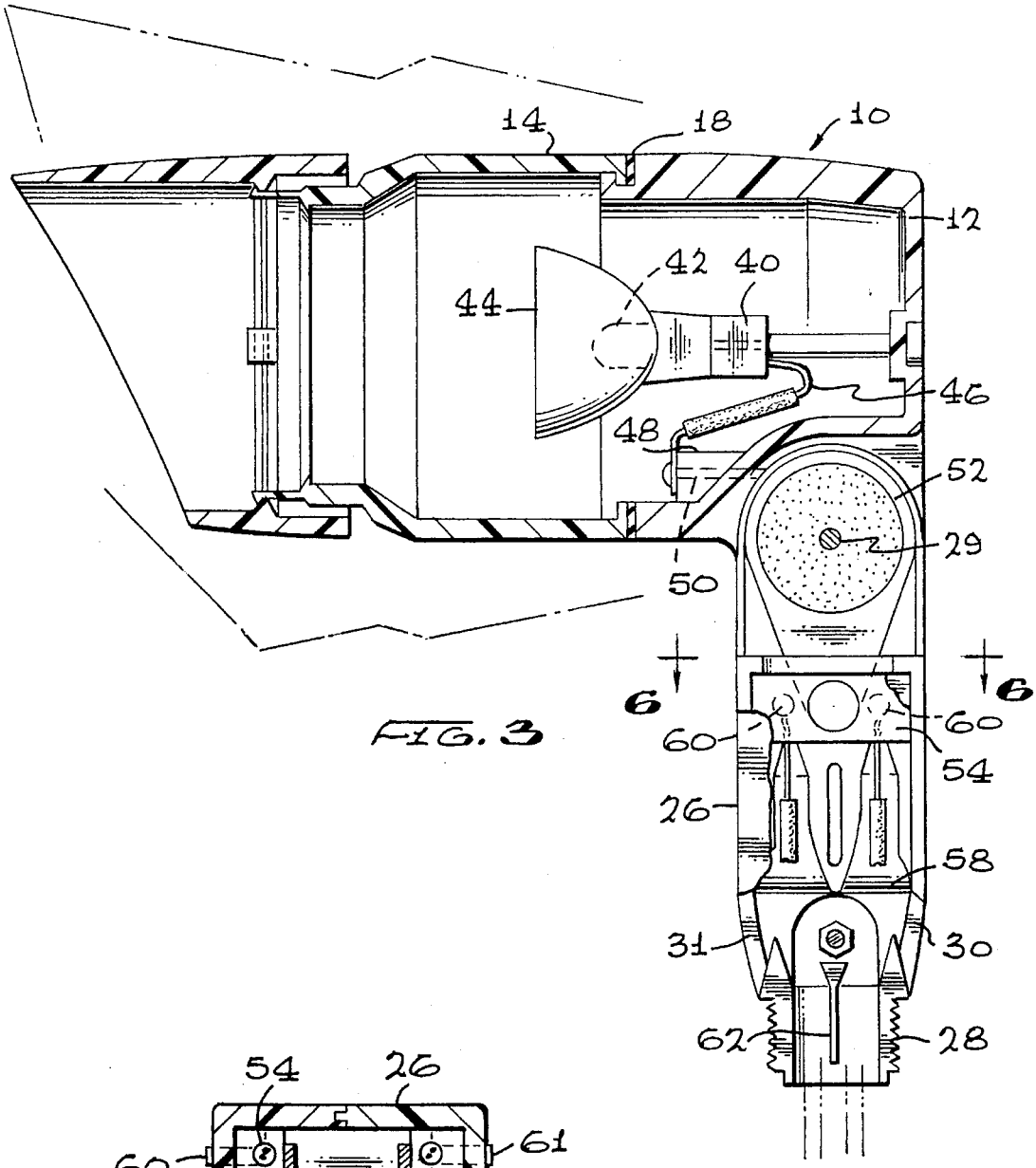
FIG. 3 is a sectional view taken along line 3—3 of FIG. 2.

FIG. 3 is a sectional drawing taken through line 3–3 of FIG. 2. Housing 10 includes a high temperature seal 18 between cylindrical parts 12 and 14. Carried in part 12 is a lamp base 40 which carries a lamp 42 and a reflector 44. Lamp base 40 is connected by means of a wire 46 to a contact pin 50 carried in a boss 48. Contact pin 50 which may be in the form of a screw rides on the surface of an arcuate contact member 52 built into the pivot structure of the fixture and which is mechanically and electrically secured to a metal (preferably brass) wiring terminal Adjustment screw 29 passes through the center of the pivot structure including flange 20, flanges 22 and 24, and contact members 52 (there is one such contact pin 50 and contact member 52 on each side of the flange 20), and serves to loosen and tighten the pivot as described above.

A molded plastic wire guide 58 is carried between the halves of base 26 and includes channels to direct wires fed either through the mounting stem 28 or opening 30 to the wiring terminal 54. Set screws 60 in wiring terminal 54 are accessible from outside base 26 to secure wires fed through wire guide 58 to wiring terminal 54. A wall 62 in stem 28 divides the inside of stem 28 into two half-cylindrical chambers. One wire pair may be fed through each side of the wall and is guided by the wire guide member 58 to each of the two brass wiring terminals where they are secured by set screws 59 and 60, of which only screws 60 are visible in FIG. 3.

Figure 4:
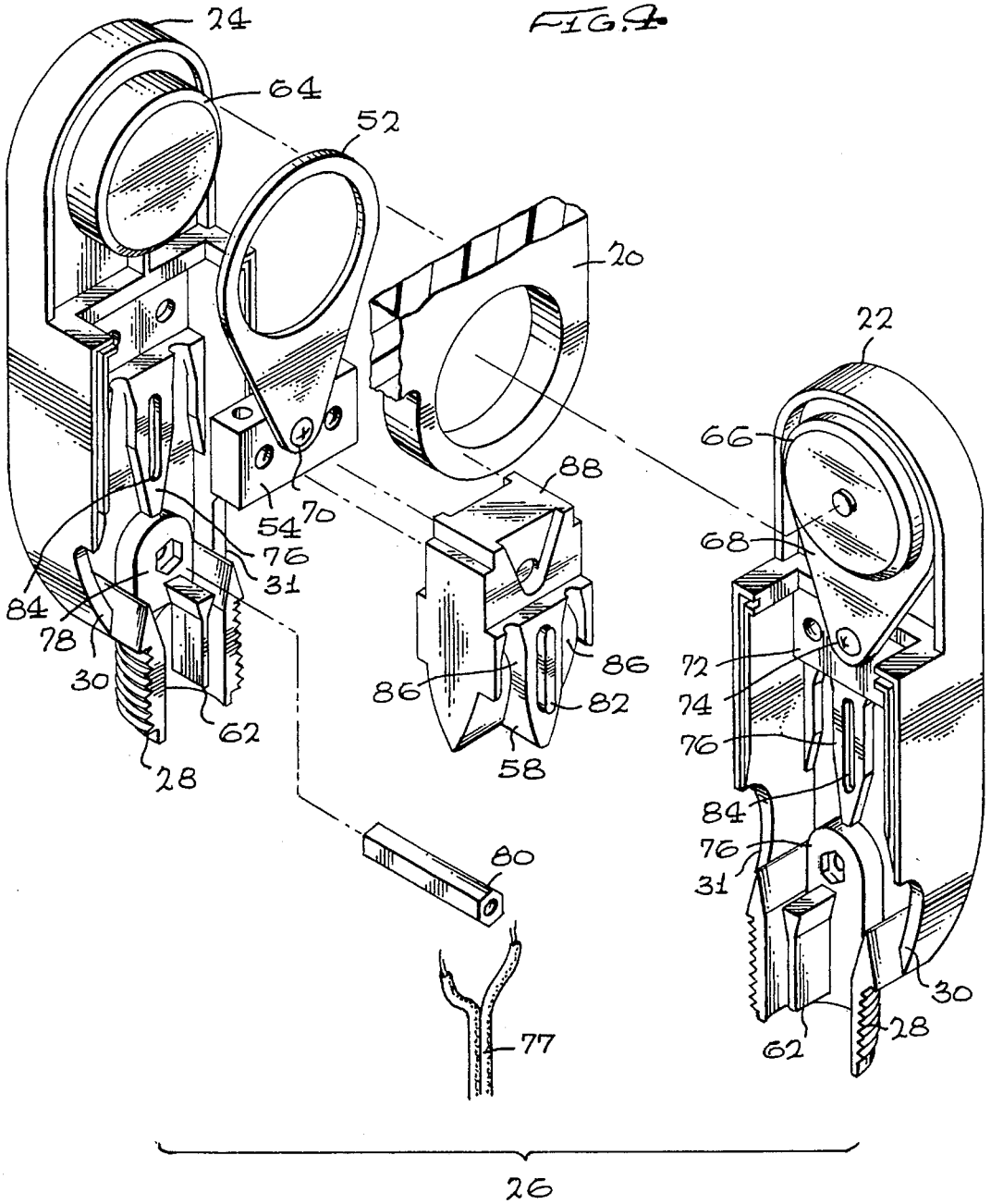
FIG. 4 is an exploded view of the base of FIGS. 1, 2, and 3.

FIG. 4 is an exploded view of the base 26 showing the separate halves including brackets 22 and 24. Flange 20 is shown broken away from cylindrical part 12. The halves of base 26 include flanges 22 and 24 with inwardly extending cylindrical projection 64 and 66, respectively. Carried on projection 64 is contact member 52 and on projection 66 is an identical contact member 68. Contact member 52 is electrically and mechanically secured to wiring terminal 54 by means of a screw 70. Contact member 68 is similarity attached to a second wiring terminal 72 by means of a screw 74.

Each of the halves of base 26 includes a molded guide 76 which cooperates with the wire guide 58 to provide channels for directing wires 77 fed either through the mounting stem 29 or through openings 30 to the wiring terminals 54 or 72. Also each half of base 26 includes a molded boss 78 having a hexagonal opening for receiving a threaded member 80 having a hexagonal cross section and which receives screws from each side of base 26 for securing the lower ends of the base halves together. When the base halves are secured together the webs in the center of the mounting stem 28 meet to form a wall 62 dividing the interior of stem 28 into two semi-cylindrical passageways such that the wire pair 77, for example, would pass on one side of wall 62 so that one wire would be directed to wiring terminal 54 and the other to wiring terminal 72. In this way electrical current is carried to the contact members 52 and 68, and to the separate contact pins 50 wired to the lamp base 42.

Figure 5:
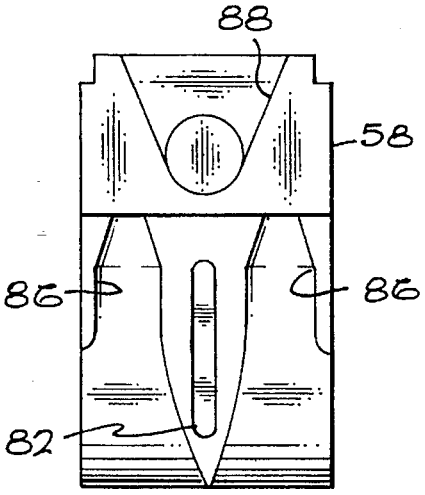
FIG. 5 is a plan view of a guide member forming part of the lamp fixture of FIGS. 1–4.

Wire guide 58 is secured in position between the halves of base 26 by means of its exterior shape and dimensions which fit the interior chamber of the base and also because of elongated molded projections 82 of which only one is visible in FIG. 4, which fit precisely in slots 84 in guides 76. (See also FIG. 5) Generally V-shaped depressions 88 at the tops of the sides of wire guide 58 accommodate the lower ends of contact members 52 and 66 and the heads of screws 70 and 74. When the halves of base 26 are secured together, the grooves 86 of wire guide 58 cooperate with mating grooves in the halves of base 26 to define channels directing wires to the terminals in terminal blocks 54 and 72.

The lamp fixture of the invention may be connected to the electrical wires as a single fixture or as one of a string of fixtures connected in parallel. When another such lamp fixture is to be connected downstream, a second pair of wires is fed through the opposite side of wall 62 in mounting stem 28, and through other groves in wire guide 58 to other terminals in terminal blocks 54 and 72.

If because of the mounting of the lamp fixture it is impossible or inconvenient to feed wires 77 through mounting stem 28, they may be fed through port 30 which also results in directing the wires through the grooves in wire guide 58 to terminals 54 and 72. Similarly, if it is desired to connect another lamp fixture downstream, another pair of wires may be fed through the opposite port 31 to the other terminals in wiring terminals 54 and 72.

Figure 6:
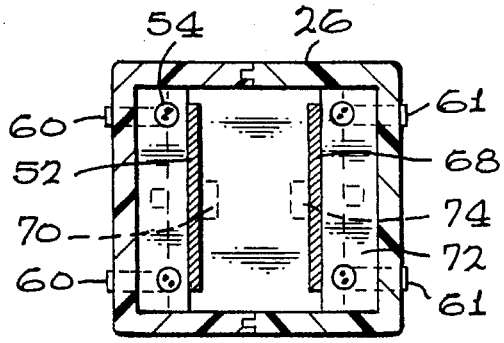
FIG. 6 is a sectional view taken along line 6—6 of FIG. 3.

FIG. 6 is a cross sectional drawing taken along line 6—6 of FIG. 3. In this view, one sees the separate halves of base 26, each of which carries one of the wiring terminals 54 or 72. The contact members 52 and 68 are shown secured to wiring terminals 54 or 72, respectively, by means of screws 70 and 74. Each of terminals 54 and 72 carry pairs of set screws 60 and 61 respectively which are accessible from the exterior of base 26 and which are used to secure the wires to the wiring terminals.

The above described embodiments of the present invention are merely descriptive of its principles and are not to be considered limiting. The scope of the present invention instead shall be determined from the scope of the following claims including their equivalents.

What is claimed is:

1. A lamp fixture to be connected to electrical conductors including a lamp housing having a radially extending flange, a lamp assembly in said housing and a base attached to said housing;

characterized in that said base comprises a pair of generally parallel flanges cooperating with said radially extending flange to form a pivot connection between said lamp housing and said base, a pair of contact members having arcuate contact surfaces positioned on opposite sides of said radially extending flange, an adjustable fastening member passing through said radially extending flange, said contact members and said generally parallel flanges to secure said lamp housing in fixed relationship to said base or to permit said lamp housing to be pivoted around said fastening member, a pair of electrical contact pins electrically connected to said lamp assembly making contact with each of said arcuate contact surfaces, electrical terminals having electrical connections with said contact members, ports in said base for receiving said electrical conductors, and means in said base for guiding said electrical conductors to said electrical terminals.

2. A lamp fixture as claimed in claim 1 wherein said base includes a pair of mating separable parts and said conductor guiding means comprises a member secured between said mating separable parts having grooves directing said electrical conductors between said ports and said electrical terminals.

3. A lamp fixture as claimed in claim 1 wherein each of said mating members includes half of a threaded mounting collar with a wall such that when said mating members are joined said base includes a threaded mounting collar with two half cylindrical passageways.

4. A lamp fixture as claimed in claim 3 wherein said threaded mounting base includes separated ports for receiving electrical conductors and directing said conductors toward said grooves.

5. A lamp fixture as claimed in claim 1 wherein said terminals include fasteners accessible from the exterior of said base for securing said electrical conductors to said electrical terminals.

6. A lamp fixture to be connected to electrical conductors including a lamp housing having a radially extending flange, a lamp assembly in said housing and a base attached to said housing;

characterized in that said base comprises two mating housing halves each having a flange cooperating with said radially extending flange to form a pivot connection between said lamp housing and said base, a pair of contact members having arcuate contact surfaces positioned on opposite sides of said radially extending flange, a pair of electrical contact pins extending from said lamp assembly making contact with each of said arcuate contact surfaces, electrical terminals having electrical connections with said contact members, a conductor guide positioned between said mating members, said guide having grooves for directing said electrical conductors to said terminals, and ports in said mating members for receiving said electrical conductors.

7. A lamp fixture as claimed in claim 6 wherein each of said mating members includes internal grooves cooperating with the grooves of said guide to direct said electrical conductors to said terminals.

8. A lamp fixture as claimed in claim 7 wherein said base includes a threaded mounting collar includes separated ports for receiving said electrical conductors and directing said conductors toward said grooves.

9. A lamp fixture as claimed in claim 6 wherein said terminals include fasteners accessible from the exterior of said base for securing said electrical conductors to said electrical terminals.

10. A lamp fixture to be connected to electrical conductors including a lamp assembly, a housing enclosing said lamp assembly to which said lamp is fastened, said housing includes a first generally cylindrical member including a radially extending flange, a second generally cylindrical member attached to an open end of said first generally cylindrical member, said members including bayonet-type fastening means for removably securing said members together;

a base attached to said first generally cylindrical member comprising two mating members each having a flange cooperating with said radially extending flange to form a pivot connection between said first generally cylindrical member and said base, a contact member having an arcuate contact surface positioned on each side of said radially extending flange, a pair of contact pins extending from said lamp assembly making contact with said arcuate members, electrical terminals electrically connected to said arcuate members, a guide positioned within said base between said mating members, said guide having grooves for directing said electrical conductors to said terminals, and ports in said mating members for receiving said electrical conductors.

11. A lamp fixture as claimed in claim 10 wherein drainage ports are located around the periphery of said second generally cylindrical member adjacent to its connection with a glare shield.

12. A lamp fixture as claimed in claim 10 wherein each of said mating members includes half of a threaded mounting collar such that when said mating members are joined said base includes a threaded mounting collar.

13. A lamp fixture as claimed in claim 12 wherein said threaded mounting base includes separated ports for receiving electrical conductors and directing said conductors toward said grooves.

14. A lamp fixture as claimed in claim 10 wherein said terminals include fasteners accessible from the exterior of said base for securing said electrical conductors to said electrical terminals.

* * * * *